US006745965B1

(12) United States Patent
Onoda et al.

(10) Patent No.: US 6,745,965 B1
(45) Date of Patent: Jun. 8, 2004

(54) TIMBER CRUSHER

(75) Inventors: Takumi Onoda, Yokohama (JP); Kouya Iizuka, Kawasaki (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/926,784

(22) PCT Filed: Jun. 28, 2000

(86) PCT No.: PCT/JP00/04255

§ 371 (c)(1),
(2), (4) Date: Dec. 19, 2001

(87) PCT Pub. No.: WO01/02096

PCT Pub. Date: Jan. 11, 2001

(30) Foreign Application Priority Data

Jun. 30, 1999 (JP) ..... 11-186980

(51) Int. Cl.[7] ..... B02C 13/31

(52) U.S. Cl. ..... 241/101.761; 241/186.4; 241/285.3

(58) Field of Search ..... 241/186.4, 101.761, 241/186.3, 285.3

(56) References Cited

U.S. PATENT DOCUMENTS 2,609,153 A * 9/1952 Moore
2,837,290 A * 6/1958 Nagel
4,997,135 A 3/1991 Zehr
5,379,951 A * 1/1995 Hughes ..... 241/60
5,419,502 A 5/1995 Morey
5,803,380 A * 9/1998 Brand et al. ..... 241/101.761

FOREIGN PATENT DOCUMENTS

JP 50-6466 1/1975
JP 63-25148 2/1988

* cited by examiner

*Primary Examiner*—Mark Rosenbaum
(74) *Attorney, Agent, or Firm*—Armstrong, Kratz, Quintos, Hanson & Brooks, LLP.

(57) ABSTRACT

A timber crusher capable of sufficiently exhibiting an effect of preventing timber pieces from scattering to an outside and also preventing damage to the crusher is provided. To this end, in the timber crusher comprising, on a base, a crusher for crushing timber into pieces and a rotary tub for guiding the timber to the crusher, a hopper (5) having an upwardly open shell part (5*b*) and guiding the charged timber to the rotary tub (3) is provided at an opening of the rotary tub (3). The hopper (5) is inclined with respect to the horizontal and is tiltable. Further, the hopper (5) may be provided with a scattering prevention cover (7) for preventing timber from scattering to an outside from an inside of the rotary tub (3).

7 Claims, 6 Drawing Sheets

TIMBER CRUSHER

TECHNICAL FIELD

The present invention relates to a timber crusher including a crusher and a rotary tub.

BACKGROUND ART

As a scattering prevention cover for preventing timber pieces crushed by a timber crusher from scattering to an outside, for example, there is conventionally an art as shown in FIG. 10 through FIG. 12. The constitution thereof will be explained based on the drawings.

A timber crusher 50 has an engine 52, and a crusher 54 rotationally driven by the engine 52 via a propeller shaft 53, on a base 51. The rotary tub 55 in a funnel form for guiding the timber charged from an outside is placed above the crusher 54, and part of an outer periphery surface of the crusher 54 is exposed to an inside of the rotary tub 55. A scattering prevention cover 56 in a shell form having a lower end edge in close vicinity of an upper end portion of the rotary tub 55 is placed at the upper edge of the rotary tub 55 to face a scattering direction Q of the timber pieces crushed by rotation of the crusher 54 as shown in FIGS. 11 and 12. As shown in FIG. 10, a conveyor 58 for discharging the crushed timber pieces to the outside is placed under the crusher 54.

According to the above-described constitution, the timber charged from an upper opening (charging port) of the rotary tub 55 is guided into the crusher 54 by the rotation of the rotary tub 55 and crushed by the crusher 54. The crushed timber pieces are discharged to the outside by the conveyor 58. The timber pieces scattering in the direction Q shown in FIG. 11 following the rotation direction of the crusher 54 when they are crushed by the crusher 54 are prevented from scattering to the outside by the scattering prevention cover 56.

However, the above-described prior art has the following disadvantages.

(1) In order to make it easy to charge timber into the rotary tub 55, the scattering prevention cover 56 cannot sufficiently cover the charging port of the rotary tub 55. Thus, crushed timber pieces easily scatter to the outside from the charging port of the rotary tub 55. Further, as shown in FIG. 12, the timber pieces forcibly collided against the scattering prevention cover 56 in a shell form disposed opposite the scattering direction Q of the timber pieces sometimes spring back in a direction 5 shown in FIG. 12 and scatter outside the rotary tub 55, whereby scattering prevention effect cannot be sufficiently obtained.

(2) The timber charged from the upper opening of the rotary tub 55 located above the crusher 54 sometimes collides directly against the crusher 54, and therefore the crusher 54 is easily damaged.

DISCLOSURE OF THE INVENTION

The present invention is made in view of the above-described disadvantages, and its object is to provide a timber crusher that can exhibit an effect of preventing timber pieces from scattering to an outside and can prevent damage to the crusher.

In order to attain the above-described object, a first aspect of a timber crusher according to the present invention is a timber crusher comprising, on a base, a crusher for crushing timber into pieces and a rotary tub for guiding the timber to the crusher, and has the constitution in which a hopper having an upwardly open shell part and guiding the charged timber to the rotary tub is provided at an opening of the rotary tub.

According to the above constitution, as a result that the hopper is provided at an opening of the rotary tub, the opening of the rotary tub is covered with the hopper. Consequently, even if the timber pieces crushed by the crusher scatter, they collide against an inner wall of the hopper and are thrown back to return into the rotary tub. Further, the timber pieces forcibly colliding and thrown back are thrown back by the inner wall of the hopper on the opposite side. Accordingly, the timber pieces scattering outside the rotary tub are reduced, thus making it possible to improve the scattering prevention effect.

Further, in the timber crusher, the hopper may be inclined with respect to the horizontal.

According to the above constitution, since the hopper is inclined with respect to the horizontal, the area of the charging port of the hopper seen from the timber charging direction is substantially larger than the area in the plan view. Specifically, the substantial area of the charging port becomes larger when the hopper is inclined than when the hopper is horizontally placed. Further, since the hopper is inclined, an operator of a charging machine (for example, a wheel loader and the like) for charging timber to the timber crusher can easily confirm the position of the charging port. For these reasons, charging of timber into the hopper is facilitated and efficiency of the timber crushing operation is improved.

Further, in the timber crusher, the hopper may be tiltable with respect to the horizontal.

According to the above constitution, the hopper is selectively tilted according to the use conditions.

Specifically, during the timber crushing operation, the hopper is tilted to facilitate the crushing operation such as charging of timber. On the other hand, at the time of transportation of the timber crusher, the hopper is made horizontal, whereby the height of the hopper, and the vehicle height of the timber crusher in its turn, are reduced and can be kept within the transportation limit value. As a result, both the crushing operation efficiency and transportability of the timber crusher can be improved.

Furthermore, in the timber crusher, the hopper may be provided with a scattering prevention cover for preventing the timber from scattering to an outside from an inside of the rotary tub.

According to the above constitution, since the hopper is provided with the scattering prevention cover, the timber pieces scattering from the crusher is thrown back at the hopper inner wall and/or the scattering prevention cover, and most of them are returned into the rotary tub. Accordingly, since the timber pieces scattering to the outside of the rotary tub are sharply reduced, the scattering prevention effect can be surely obtained.

Further, in the timber crusher, the scattering prevention cover may be inclined downward to a timber charging port of the rotary tub.

According to the above constitution, even if the timber pieces forcibly collide against the scattering prevention cover, the scattering prevention cover is inclined downward to the timber charging port, and therefore the timber pieces are thrown back into the rotary tub. Accordingly, the probability of the timber pieces scattering toward the timber charging port is extremely low, and therefore the scattering prevention effect can be surely exhibited. In addition, since the scattering prevention cover also has the function of a chute for transferring the timber charged into the hopper to the charging port, timber is easily charged into the rotary tub, and the efficiency of the timber crushing operation is improved. Further, since the timber can be dropped onto the scattering prevention cover (specifically, the chute), the dropped timber does not directly collide against the crusher, and thus damage to the crusher can be prevented.

A second aspect of a timber crusher according to the present invention is a timber crusher comprising, on a base, a crusher rotating around a substantially horizontal rotation axis and crushing timber into pieces, a rotary tub for guiding the charged timber to the crusher, and a scattering prevention cover for preventing the timber from scattering to an outside from an inside of the rotary tub, and has the constitution in which a timber charging port is formed at an opening of the rotary tub by an edge portion of the scattering prevention cover, and a direction of the edge portion is a direction rotated a predetermined angle in a rotational direction of the rotary tub with respect to a rotation axis direction of the crusher, in a plan view.

According to the above constitution, the direction of the edge portion of the scattering prevention cover forming the timber charging port of the rotary tub is set to oppose a main direction in which the timber pieces crushed by the crusher scatter, at a substantially right angle. Specifically, based on the fact that the timber pieces crushed by the crusher normally scatter in the composite direction of the rotational direction of the crusher and the rotational direction of the rotary tub, the scattering prevention cover is placed. As a result, the timber pieces scattering in the composite direction collide against the scattering prevention cover and the quantity thereof returned to the inside of the rotary tub is increased, thus making it possible to sharply reduce the quantity of timber pieces scattering to the outside of the rotary tub.

A third aspect of the timber crusher according to the present invention is a timber crusher comprising, on a base, a crusher rotating around a substantially horizontal rotation axis and crushing timber into pieces, a rotary tub for guiding the charged timber to the crusher, and a scattering prevention cover for preventing the timber from scattering to an outside from an inside of the rotary tub, and has the constitution in which the scattering prevention cover forms a timber charging port at an opening of the rotary tub and covers at least part of the crusher exposed into the rotary tub.

According to the above constitution, the scattering prevention cover forming part of the timber charging port of the rotary tub covers at least part of the crusher exposed into the rotary tub. As a result, the timber charged from the charging port hardly collides directly against the crusher, and thus damage to the crusher can be prevented.

A fourth aspect of the timber crusher according to the present invention is a timber crusher comprising, on a base, a crusher for crushing timber into pieces, a rotary tub for guiding the charged timber to the crusher, and a scattering prevention cover for preventing the timber from scattering to an outside from an inside of the rotary tub, and further comprises bearers attached on the base, for rotatably attaching the scattering prevention cover, having the constitution in which the scattering prevention cover is formed to be expandable and contractible by a plurality of rotatable frames at the bearers and a sheet stretched between the plurality of frames, and freely covers an opening of the rotary tub by expanding and contracting the sheet.

According to the above constitution, a wide range of the opening of the rotary tub can be covered with the scattering prevention cover formed to be expandable and contractible by the sheet and a plurality of frames, thus making it possible to surely prevent the timber pieces from scattering outside the rotary tub. In addition, by making the scattering prevention cover in a contracted state, the height of the scattering prevention cover can be kept within the transportation limit value by the transport vehicle, thus making it possible to improve transportability of the timber crusher.

Furthermore, in the timber crusher, the timber crusher may be mounted on a mobile vehicle.

According to the above constitution, since the timber crusher is mounted on the mobile vehicle to be movable, it is possible to perform crushing operations, moving between a plurality of accumulation spots of timber to be crushed. As a result, it is not necessary to convey timber to the timber crusher from a plurality of accumulation spots as a stationary timber crusher, and the efficiency of timber crushing operation is improved. Further, loading onto the transport vehicle is facilitated at the time of transfer to the operation site, thus making it possible to improve operability at the time of transport.

BEST MODE FOR CARRYING OUT THE INVENTION

A preferred embodiment of the present invention will be explained in detail below with reference to FIG. 1 through FIG. 9.

First, the constitution of a first embodiment will be explained based on FIGS. 1 and 2. A timber crusher 10 includes traveling equipment 9 free to travel at a bottom portion, and is provided with a base 1 on the traveling equipment 9. The traveling equipment 9 is a track-laying type in this embodiment, but it may be a wheel-equipped type. Further, in the following embodiments according to the present invention, the explanation is made with an example in which the timber crusher 10 includes the traveling equipment 9, but the timber crusher 10 of the present invention is not limited to this. Specifically, a main object of the present invention is to improve effect of preventing timber pieces from scattering to an outside, and/or to prevent damage to the crusher, and the timber crusher 10 basically has the constitution including at least a crusher for crushing timber, and a rotary tub for guiding the timber to the crusher. Accordingly, the timber crusher 10 of the present invention includes i) the timber crusher 10 that has wheels and the like for traveling, but cannot travel for itself, and is towed by a self-propelled vehicle and the like, ii) the timber crusher 10 that does not have traveling equipment, traveling wheels or the like, but is mounted on a self-propelled vehicle or the like and is able to travel, and iii) the stationary type of the timber crusher 10 that does not have traveling equipment, traveling wheels or the like, and is usually used in the place where it is set.

Figure 10:
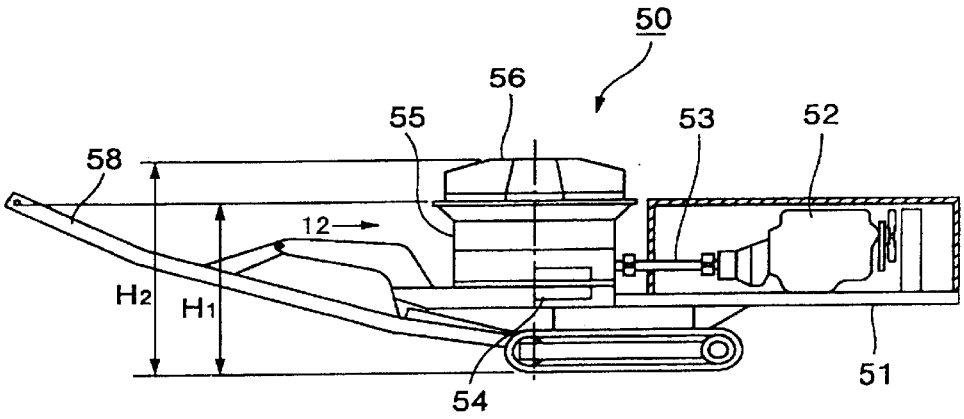
FIG.10 PRIOR ART
FIG. 10 is a side view of a timber crusher according to a prior art.
Figure 11:
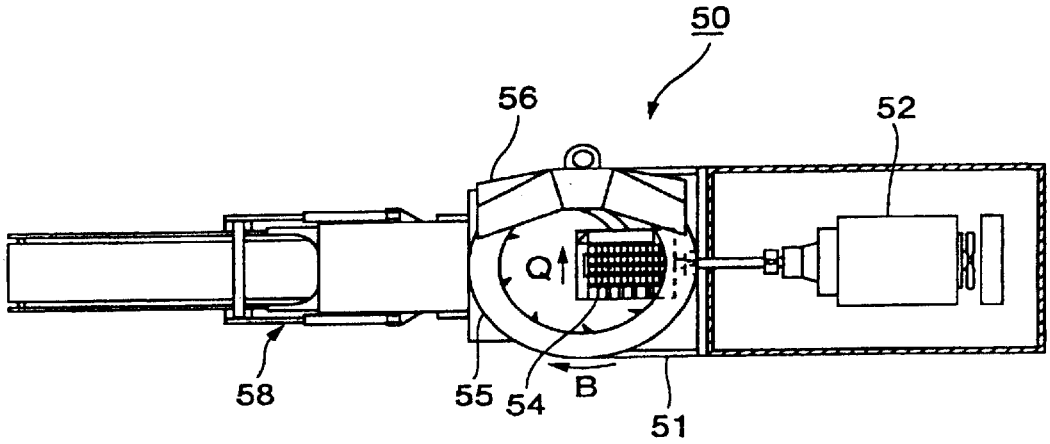
FIG.11 PRIOR ART
FIG. 11 is a plan view of FIG. 10.
Figure 12:
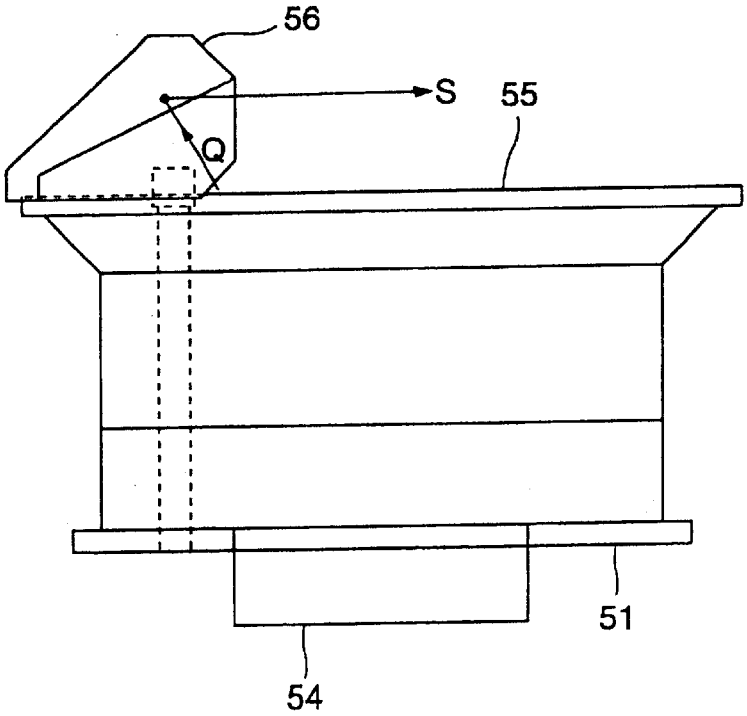
FIG.12 PRIOR ART
FIG. 12 is a view seen from the arrow 12 in FIG. 10.

An engine 52 is mounted on a rear part of the base 1. A crusher 2 connected via hydraulic motor 42 having a hydraulic pump 41 driven by the engine 52 as a drive source and a propeller shaft 53 is provided in front of the engine 52. Part of the crusher 2 in a circumferential direction is exposed on a surface of the base 1 to crush timber. A conveyor equivalent to a conveyor 58 shown in FIG. 10 is included, but it is not shown in FIG. 1.

A rotary tub 3 for guiding timber charged from the outside while rotating it is rotatably placed on a top portion of the base 1 above the crusher 2. Part of an outer periphery portion of the crusher 2 is exposed from a bottom surface of the rotary tub 3 at the position eccentric toward a rear side in a traveling direction with respect to a center of rotation of the rotary tub 3. A hopper 5 is placed to be tiltable above an upper opening of the rotary tub 3. Specifically, two support pillars 4 and 4 are vertically provided spaced from each other on the base 1 outside the rotary tub 3, and on the opposite side of the crusher 2 side. One side of the hopper 5 for guiding the timber charged from the outside into the rotary tub 3 is pivotally supported rotatably at upper end portions of the two support pillars 4 and 4. Two hydraulic cylinders 6 and 6 are attached to be vertically expandable and contractible between the base 1 on the crusher 2 side and the other side of the hopper 5 at the opposite side of the support pillars 4 and 4. The hydraulic cylinders 6 and 6 are one example of drive means, and FIG. 2 shows only one of the hydraulic cylinders 6. The hopper 5 is defined by an upper funnel part 5*a* and a lower shell part 5*b*. The shell part 5*b* is capable of overlapping an upper portion of the rotary tub 3 at a position in close vicinity of an upper end portion of the opening of the rotary tub 3 when the hopper 5 is tilted.

The hopper 5 is placed in the state in which it is inclined at an angle q (see FIG. 1) so that one side is higher with respect to the horizontal during a timber crushing operation. A scattering prevention cover 7 for partly covering an area above the crusher 2 is provided inside the funnel part 5*a* of the hopper 5 and above the opening of the rotary tub 3. The scattering prevention cover 7 forms a part, which is not covered with the scattering prevention cover 7 above the opening of the rotary tub 3, as a timber charging port 5*d*, and it is slantingly provided toward the charging port 5*d*. The scattering prevention cover 7 has its upper end portion pivotally supported by a hinge 8 to be openable and closable with respect to the hopper 5. The hopper 5 is tiltable in this embodiment, but it may be fixed.

The operational effect of the first embodiment will be explained. Since the hopper 5 is provided at the upper opening (timber charging port) of the rotary tub 3, the timber pieces crushed by the crusher 2 are thrown back at an inner wall surface of the hopper 5 and returned into the rotary tub 3. Further, the timber pieces forcibly colliding against the inner wall surface of the hopper 5 are thrown back at the inner wall surface at the opposite side from the spot at which they are initially thrown back, and are returned into the rotary tub 3. Accordingly, quantity of timber pieces scattering to the outside of the rotary tub 3 becomes extremely small. In the case of the inclined hopper 5 as shown in FIGS. 1 and 2, timber pieces scatter in a rotational direction R (specifically, in a lateral direction with respect to a longitudinal direction of the vehicle) of the crusher 2, collide against the inner surface of the shell part 5*b* of the hopper 5 and are thrown back, then thrown back at the shell part 5*b* at the opposite side and the funnel part 5*a*, and returned into the rotary tub 3. Thus, the quantity of timber pieces scattering to the outside of the rotary tub 3 is reduced, and the scattering prevention effect can be improved.

Further, the scattering prevention cover 7 may be provided at the hopper 5. The scattering prevention cover 7 in this embodiment is provided so that its upper end portion is in contact with the top surface on the outer periphery side of the funnel part 5*a* and its lower end portion forming the charging port 5*d* with the opening of the hopper 5 is inclined downward to the charging port 5*d*. As a result, timber pieces forcibly colliding against the scattering prevention cover 7 out of the rotary tub 3 are thrown back and returned into the rotary tub 3, and therefore they don't scatter out of the rotary tub 3. Consequently, scattering prevention effect can be surely obtained.

Even when an area of the scattering prevention cover 7 in the plan view is the same when the hopper 5 is inclined with respect to the horizontal and when the hopper 5 is in a horizontal state, the substantial area of the timber charging port 5*d* seen from a charging direction becomes larger when the hopper 5 is inclined than when it is horizontal. Specifically, as shown in FIG. 1, when the maximum lengths of the timber charging port 5*d* in an inclined state (the present embodiment) and in a horizontal state in the side view are L1 and L0 respectively, L1>L0. Accordingly, by inclining the hopper 5 during a crushing operation, it becomes easy to charge timber to be crushed into the rotary tub 3 via the hopper 5, and thus the efficiency of the timber crushing operation can be improved.

Figure 1:
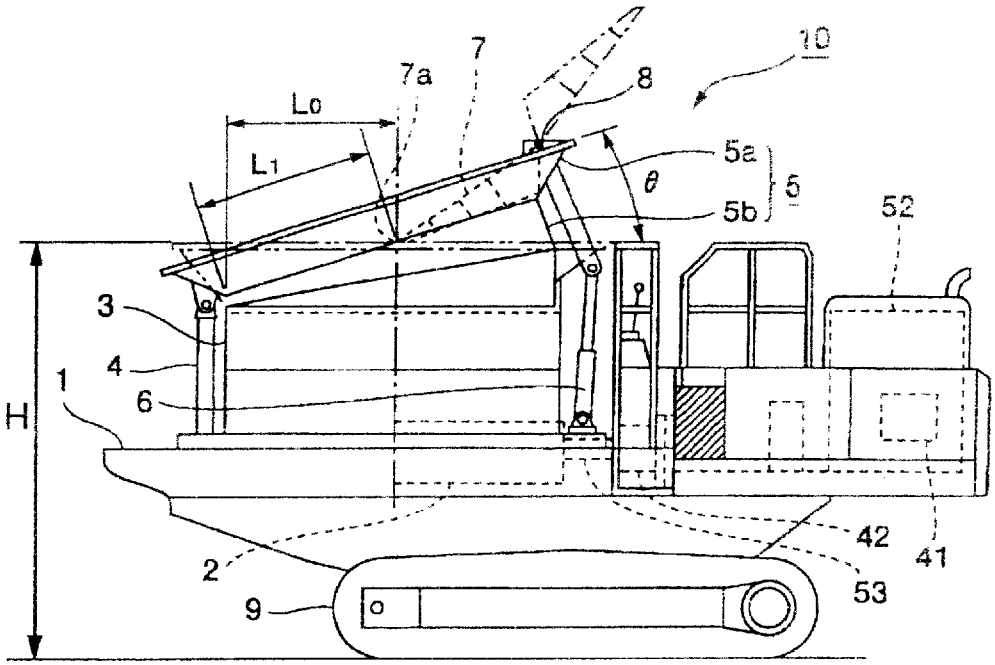
FIG. 1 is a side view of a timber crusher according to a first embodiment of the present invention.
Figure 2:
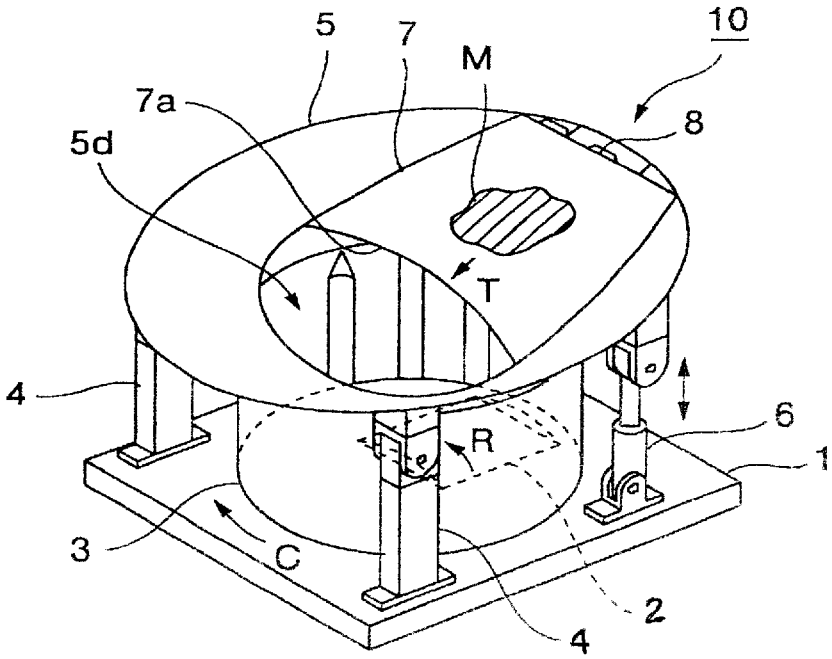
FIG. 2 is a perspective view of an essential part of the timber crusher in FIG. 1.

Further, at the time of transport, the hydraulic cylinders 6 and 6 are contracted to tilt the hopper 5 until the upper end surface of the hopper 5 is horizontal as shown by the two-dot chain lines in FIG. 1, and the height of the hopper 5 is kept within a transportable limit value (for example, a height H in FIG. 1), whereby transportation by a vehicle such as a truck is made possible. As a result, transportability of the timber crusher 10 can be improved.

Furthermore, when the scattering prevention cover 7 is provided to be inclined downward toward the timber charging port 5*d* inside the hopper 5, timber pieces forcibly colliding against a backside of the scattering prevention cover 7 are thrown back at the scattering prevention cover 7 and returned into the rotary tub 3, and therefore they hardly scatter to the timber charging port 5*d*. Consequently, scattering prevention effect can be surely exhibited. Further, the scattering prevention cover 7 works as a chute in which a timber M charged into the hopper 5 is moved in a direction of the arrow T by its own weight to be transferred to the charging port 5*d*, and therefore the timber M slidingly falls and is easily charged into the rotary tub.3, thus improving the efficiency of the crushing operation of the timber M.

At the time of checkup and cleaning of the inside of the rotary tub 3, the scattering prevention cover 7 is turned around the hinge 8 to open the upper opening portion of the rotary tub 3 as shown by the two-dot chain lines in FIG. 1, whereby the checkup and cleaning operation can be easily performed. Further, regarding the inclination of the hopper 5, the inclined angle within a predetermined range may be set so that optional opposite direction side are lowered with respect to the rotational direction of the crusher 2 to facilitate the loading of timber into the hopper 5. The "optional opposite direction side" is a direction set at the opposite direction side to the rotational direction of the crusher 2 as necessary.

Figure 3:
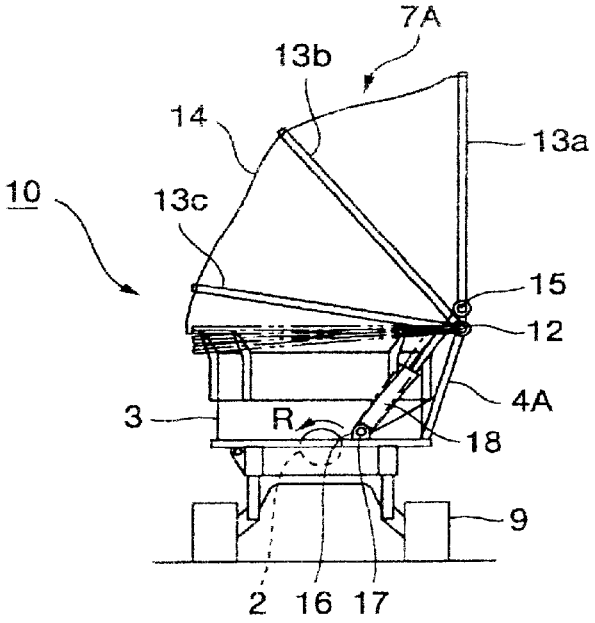
FIG. 3 is a front view of a timber crusher according to a second embodiment of the present invention.
Figure 4:
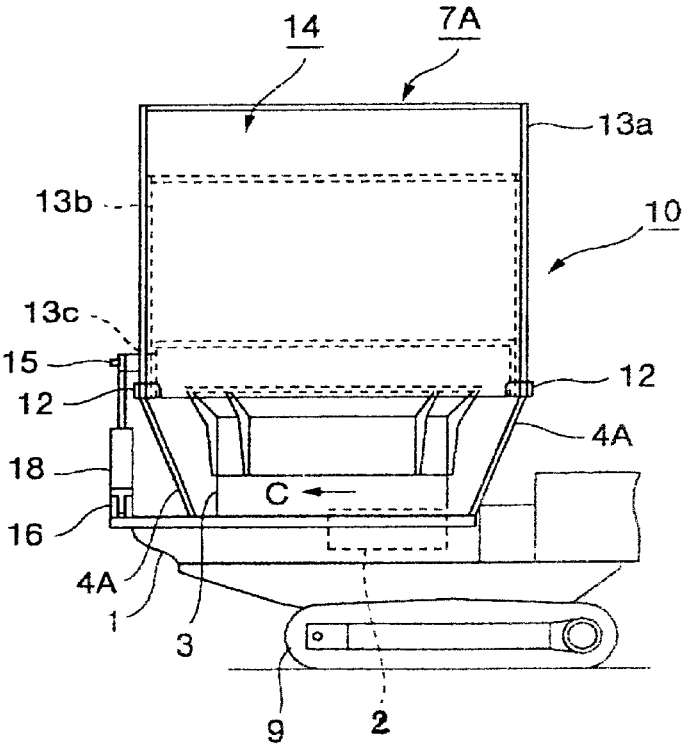
FIG. 4 is a side view of the timber crusher in FIG. 3.

Next, a second embodiment will be explained based on FIGS. 3 and 4. A scattering prevention cover 7A is formed to be expandable and contractible by three portal frames 13*a*, 13*b* and 13*c* rotatably attached around pins 12 and 12 provided at upper portions of a pair of bearers 4A and 4A attached at the base 1, and a sheet 14 fixed to the portal frames 13*a*, 13*b* and 13*c*. A hydraulic cylinder 18 being an example of expanding and contracting drive means for expanding and contracting the scattering prevention cover 7A is attached between a pin 15 fixed to the outermost portal frame 13*a* and a pin 17 attached to a bracket 16 fixed to the base 1. A couple of bearers 4A and 4A are used in the second embodiment, but this is not restrictive, and one bearer formed by integrating a pair of bearers 4A and 4A may be used. The constitution of the base 1, the crusher 2, the rotary tub 3 and the like other than the above is the same as that in the first embodiment.

The operational effect of the second embodiment will be explained. When the hydraulic cylinder 18 is extended and the scattering prevention cover 7A formed to be expandable and contractible are opened as shown in FIG. 3, a wide range of an area above the opening of the rotary tub 3 is covered with the sheet 14. Thus, the timber pieces crushed by the crusher 2 can be surely prevented from scattering outside the rotary tub 3. Further, the hydraulic cylinder 18 is contracted and the sheet 14 is folded to be in a state shown by the two-dot chain lines in FIG. 3 so that the height of the upper end portion of the scattering prevention cover 7A is within the transportation limit value, whereby the transportability of the timber crusher 10 can be improved.

The operational effects of the traveling unit 9, the base 1, the crusher 2, the rotary tub 3 and the like other than the above are the same as those in the first embodiment. In the scattering prevention cover 7A in the second embodiment, the sheet 14 is expanded and contracted in a bellow state, but this is not restrictive, and the constitution in which, for example, a plurality of metal plates are slid to be expanded and contracted may be used.

Figure 5:
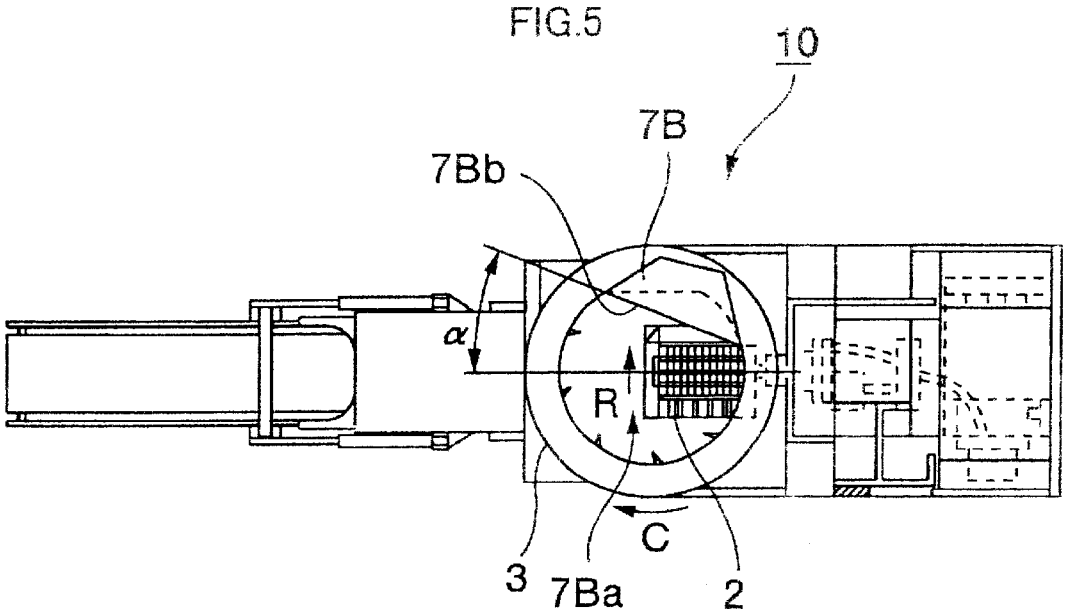
FIG. 5 is a plan view of a timber crusher according to a third embodiment of the present invention.

Next, a third embodiment will be explained based on FIG. 5. In the timber crusher 10, a direction of an edge portion 7Bb of the scattering prevention cover 7B forming a timber charging port 7Ba is rotated a predetermined angle a in a rotational direction C of the rotary tub 3 with the rotation axis direction of the crusher 2 as the reference in the plan view of the timber crusher 10. In the third embodiment, the scattering prevention cover 7B is provided at an inside of the rotary tub 3, but it may be provided at an outside of the rotary tub 3. The constitution of the traveling unit 9, the base 1 (both are not shown), the crusher 2, the rotary tub 3 and the like other than the above is the same as that in the first embodiment, and thus the explanation thereof will be omitted.

The operational effect of the third embodiment will be explained. The timber pieces crushed in the crusher 2 scatter in a composite direction of a velocity component in a rotational direction R of the crusher 2 and a velocity component in a rotational direction C of the rotary tub 3, and the scattering prevention cover 7B is disposed at the position of the composite direction. Accordingly, the quantity of the wood pieces colliding against the scattering prevention cover 7B, thrown back and returning to the inside of the rotary tub 3 increases, and thus the quantity of the timber pieces scattering to the outside of the rotary tub 3 can be reduced to a large extent. The operational effects of the traveling unit 9 and the base 1 (both are not shown), the crusher 2, the rotary tub 3 and the like other than the above are the same as those in the first embodiment and the explanation thereof will be omitted.

Figure 6:
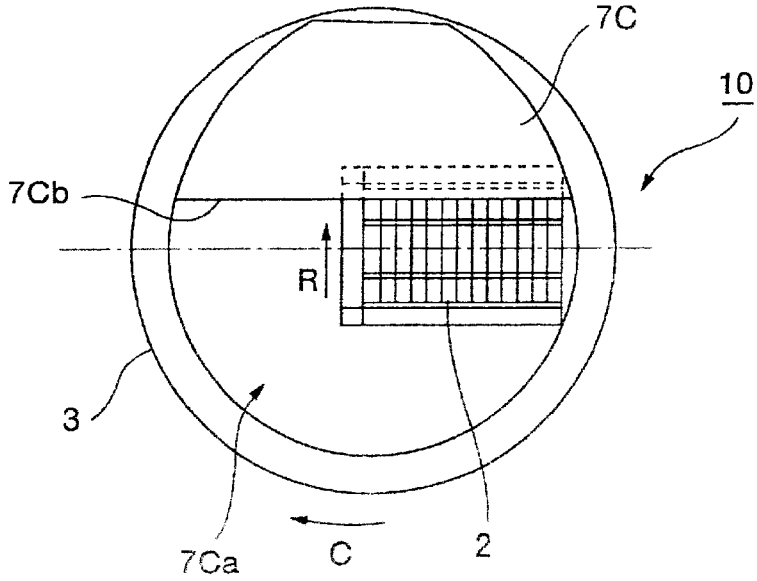
FIG. 6 is a plan view of an essential part of a timber crusher according to a fourth embodiment of the present invention.

A fourth embodiment will be explained based on FIG. 6. An edge portion 7Cb of a scattering prevention cover 7C forming a timber charging port 7Ca is disposed in a rotation axis direction of the crusher 2 in the plan view of the timber crusher 10. The scattering prevention cover 7C is formed to cover at least part of the crusher 2 exposed into the rotary tub 3. The constitution of the traveling unit 9 and the base 1 (both are not shown), the crusher 2, the rotary tub 3 and the like other than the above is the same as that in the first embodiment.

The operational effects of the fourth embodiment will be explained. At least part of the crusher 2 exposed into the rotary tub 3 is covered with the scattering prevention cover 7C with the edge portion 7Cb being formed in parallel with the rotation axis direction of the crusher 2, and therefore the timber charged from the charging port 7Ca hardly collide directly against the crusher 2 exposed into the rotary tub 3. Accordingly, damage to the crusher 2 can be prevented. Further, the rate at which the timber pieces scatter by the rotation of the crusher 2 is high, but the scattering prevention cover 7C covers the crusher 2, and thus the favorable effect of prevention of scattering outside is obtained. The operational effects of the traveling unit 9 and the base 1 (both are not shown), the crusher 2, the rotary tub 3 and the like other than the above are the same as those in the first embodiment.

Figure 7:
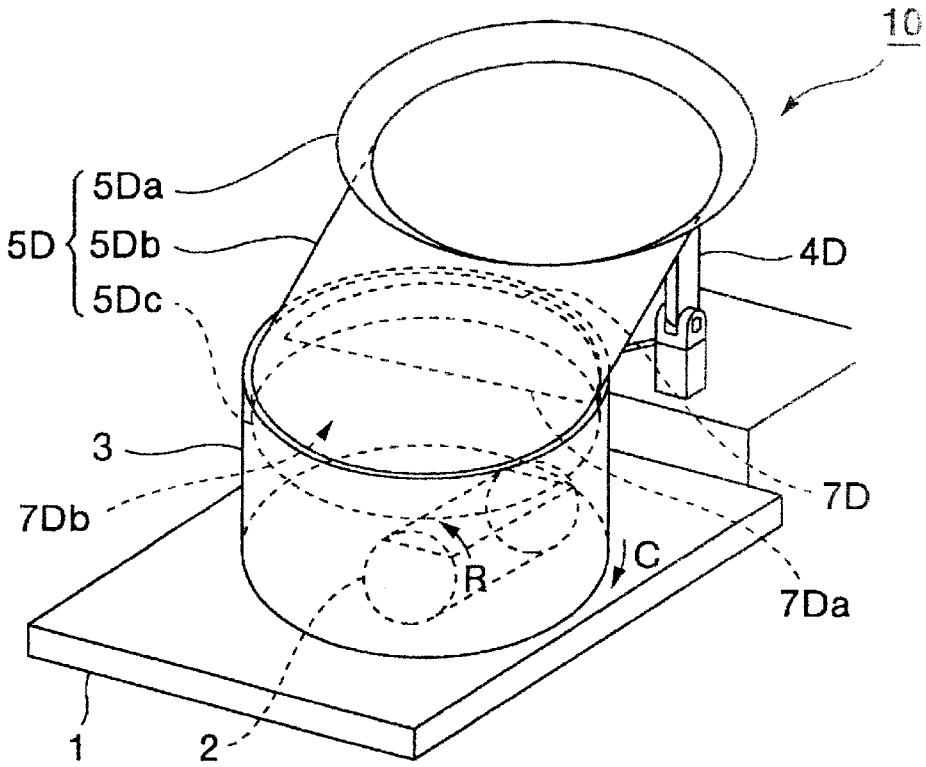
FIG. 7 is a perspective view of an essential part of a timber crusher according to a fifth embodiment of the present invention.

A fifth embodiment will be explained based on FIG. 7. The rotary tub 3 for guiding the timber charged from outside while rotating it is placed above the crusher 2. A hopper 5D supported by two bearers 4D vertically provided on the base 1 outside the rotary tub 3 is placed above the opening, of the rotary tub 3. The hopper 5D is constituted by a funnel part 5Da, a first shell part 5Db continuing from a lower portion of the funnel part 5Da to an obliquely lower position, and a second shell part 5Dc provided at a lower portion of the first shell part 5Db. The funnel part 5Da, the first shell part 5Db and the second shell part 5Dc may be integrally constructed, or may be separately constructed to be attachable. The second shell part 5Dc is inserted into the upper portion of the rotary tub 3, and the rotary tub 3 is rotatable while partly sliding on the second shell part 5Dc.

A scattering prevention cover 7D is attached at an upper portion of an inner surface of the second shell part 5Dc, and a timber charging port 7Db is formed by an edge portion 7Da of the scattering prevention cover 7D. The constitution of the traveling equipment 9 (not shown), the base 1, the crusher 2, the rotary tub 3 and the like other than the above is the same as that in the first embodiment. FIG. 7 shows the constitution in which the second shell part 5Dc is inserted into the rotary tub 3, but the present invention is not limited to this, and, for example, the constitution in which the second shell part 5Dc is fitted onto the rotary tub 3 (specifically, the second shell part 5Dc covers the outside of the rotary tub 3) may be adopted.

The operational effect of the fifth embodiment will be explained. The timber charged from the funnel part 5Da is transferred in a direction of the scattering prevention cover 7D by the first shell part 5Db, and is guided into the rotary tub 3 from the timber charging port 7Db. Consequently, the charged timber does not directly collide against the crusher 2 exposed into the rotary tub 3, thus preventing damage to the crusher 2. The timber pieces crushed by the crusher 2 and scattered are thrown back by the scattering prevention cover 7D and the first shell part 5Db and returned into the rotary tub 3, thus making it possible to reduce the quantity of the timber pieces scattering outside the hopper 5D to a large extent. The operational effects of the traveling equipment 9 and the base 1 (both are not shown), the crusher 2, the rotary tub 3 and the like other than the above are the same as those in the first embodiment.

Figure 8:
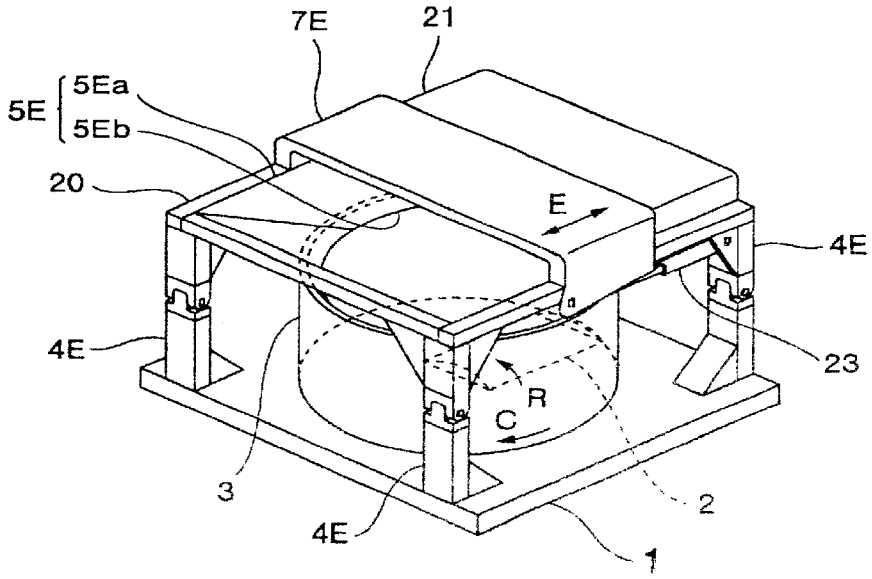
FIG. 8 is a perspective view of an essential part of a timber crusher according to a sixth embodiment of the present invention.

A sixth embodiment will be explained based on FIG. 8. The rotary tub 3 for guiding the timber charged from an outside while rotating it is placed above the crusher 2. A hopper 5E supported by four bearers 4E vertically placed on the base 1 outside the rotary tub 3 is placed above the upper opening of the rotary tub 3. The hopper 5E is constituted by a funnel part 5Ea, and a shell part 5Eb extensively formed in a further inner direction from the upper opening of the rotary tub 3 at the same inclination as the funnel part 5Ea. The inclination of the shell part 5Eb is not limited to the same as the funnel part 5Ea, but it may be set at different inclinations including the same form as the second shell part 5Dc in FIG. 7 as necessary.

A fixed cover 21 is attached at one end portion of a rectangular frame 20 with the upper portion of the funnel part 5Ea being fixed thereto. A scattering prevention cover 7E is placed outside the fixed cover 21. The scattering prevention cover 7E is movable in the direction of the arrow E with respect to the frame 20 and the fixed cover 21 by a hydraulic cylinder 23 attached between the scattering prevention cover 7E and the bearer 4E. The constitution of the traveling equipment 9 (not shown), the base 1, the crusher 2, the rotary tub 3 and the like other than the above is the same as that in the first embodiment.

The operational effect of the sixth embodiment will be explained. When a timber to be crushed is charged into the rotary tub 3, the hydraulic cylinder 23 is contracted to retreat the scattering prevention cover 7E, thereby increasing an opening area of the hopper 5E to facilitate the operation of charging timber into the rotary tub 3. During a timber crushing operation, the hydraulic cylinder 23 is extended to move the scattering prevention cover 7E forward, whereby the opening of the rotary tub 3 is closed to prevent the crushed timber pieces from scattering out of the rotary tub 3. The operational effects of the traveling equipment 9 (not shown), the base 1, the crusher 2, the rotary tub 3 and the like other than the above are the same as those in the first embodiment. During a timber crushing operation, an area above the crusher 2 may be partially covered with the scattering prevention cover 7E to partially open the timber charging port of the hopper 5E, and timber may be successively charged in the state in which the rotational speed of the rotary tub 3 is made lower.

Figure 9:
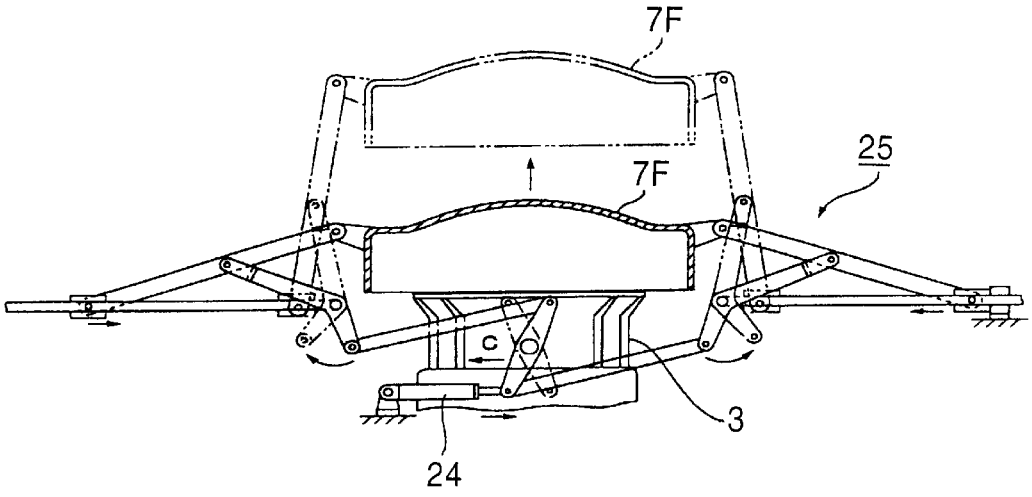
FIG. 9 is a side view of an essential part of a timber crusher according to a seventh embodiment of the present invention.

A seventh embodiment will be explained based on FIG. 9. The detailed explanation will be omitted, but the seventh embodiment has the constitution in which a scattering prevention cover 7F for covering the opening of the rotary tub 3 and a hydraulic cylinder 24 are connected ,by a so-called Scott-Russell mechanism 25. When the hydraulic cylinder 24 is extended, the Scott-Russell mechanism 25 is in a state shown by the two-dot chain lines, and the scattering prevention cover 7F rises to a position of the two-dot chain lines to open the upper opening of the rotary tub 3. When the hydraulic cylinder 24 is contracted, the Scott-Russell mechanism 25 is in a state of the solid lines, and the scattering prevention cover 7F lowers to a position of the solid lines to close the opening of the rotary tub 3. The constitution of the travelling unit 9, the base 1 and the crusher 2 (both are not shown), the rotary tub 3 and the like other than the above is the same as that in the first embodiment.

The operational effects of the seventh embodiment will be explained. When the timber to be crushed is charged into the rotary tub 3, the hydraulic cylinder 24 is extended in a direction of the arrow, and each link of the Scott-Russell mechanism 25 is rotated in a direction of the arrow, whereby scattering prevention cover 7F rises in the direction of the arrow up to the position of the two-dot lines. As a result, the opening of the rotary tub 3 is widely opened, thus facilitating an operation of charging timber into the rotary tub 3. During a timber crushing operation, the hydraulic cylinder 24 is contracted and the scattering prevention cover 7F is lowered to the position of the solid lines, whereby the opening of the rotary tub 3 is closed and the crushed timber pieces are prevented from scattering out of the rotary tub 3. The operational effects of the traveling equipment 9, the base 1 and the crusher 2 (both are not shown), the rotary tub 3 and the like other than the above are the same as those in the first embodiment.

As described thus far, according to the present invention, the following effects are obtained.

(1) Since the hopper is provided at the opening (timber charging port) of the rotary tub, the scattered timber pieces are thrown back at the inner wall of the hopper, and the timber pieces forcibly colliding against it are thrown back at the inner wall at the opposite side of the throwing-back portion of the hopper to be returned into the rotary tub. Further, by providing the hopper with the scattering prevention cover, timber pieces are thrown back at the hopper and/or the scattering prevention cover and returned into the rotary tub, and therefore the quantity scattering outside the rotary tub is further reduced. Accordingly, the effect of preventing scattering outside the rotary tub can be surely exhibited.

(2) As the result that the hopper is provided at the rotary tub to be inclined with respect to the horizontal, the area of the timber charging port seen in the timber charging direction becomes larger in the case with the inclined hopper than in the case with the horizontal hopper even if the area of the hopper of the timber crusher in the plan view is the same when the area of the hopper is inclined and when it is in the horizontal state. Consequently, timber can be easily charged into the hopper, and the timber crushing operation efficiency is improved.

(3) When the hopper is provided at the opening of the rotary tub to be tiltable, the hopper can be horizontally tilted by the tilting drive means at the time of transportation, and the height of the hopper can be within the transportation limit value, thus improving transportability of the timber crusher.

(4) By providing the scattering prevention cover to be inclined downward to the timber charging port inside the hopper, the scattering prevention effect of the scattering prevention cover can be improved. In addition, the scattering prevention cover also works as a chute for transferring the timber charged into the hopper to the charging port, and therefore the timber is easily charged into the rotary tub, thus making it possible to improve the efficiency of the timber crushing operation.

(5) The crushed timber pieces are mainly scattered in the composite direction of the velocity component in the rotational direction of the crusher and the velocity component of the rotational direction of the rotary tub. When the scattering prevention cover is provided to oppose the composite direction, the quantity of the timber pieces colliding against the scattering prevention cover and returned to the inside of the rotary tub is increased. Consequently, the quantity of the timber pieces scattering outside the rotary tub can be sharply reduced.

(6) The direction of the edge portion of the scattering prevention cover, which forms the timber charging port, may be placed in the rotation axis direction of the crusher in the plan view, and at least part of the crusher exposed into the rotary tub may be covered with the scattering prevention cover. In this case, the timber charged from the charging port hardly collides directly against the crusher, thus making it possible to prevent damage to the crusher. Further, scattering of the timber pieces by rotation of the crusher can be surely prevented by the scattering prevention cover.

(7) By covering the wide range of the opening of the rotary tub with the scattering prevention cover formed to be expandable and contractible, the timber pieces can be surely prevented from scattering outside the rotary tub. Further, by reducing the scattering prevention cover formed to be expandable and contractible, the height of the scattering prevention cover is kept within the transportation limit value, and thus the transportability of the timber crusher can be improved.

Industrial Availability

The present invention is useful as a timber crusher, which can sufficiently exhibit an effect of preventing timber pieces from scattering to the outside, and can also prevent damage to the crusher.

What is claimed is:

1. A timber crusher comprising on a base, a crusher for crushing timber into pieces and a rotary tub for guiding the timber to said crusher, wherein a hopper having an upwardly open shell part and guiding the charged timber to said rotary tub is provided at an opening of said rotary tub, and said hopper is tiltable with respect to the horizontal and said base to enable said hopper to be positioned at a selected angle with respect to the horizontal so as to have said hopper at said selected angle during operation of said timber crusher.

2. A timber crusher comprising, on a base, a crusher for crushing timber into pieces and a rotary tub for guiding the timber to said crusher, wherein a hopper having an upwardly open shell part and guiding the charged timber to said rotary tub is provided at an opening of said rotary tub, wherein said hopper is provided with a scattering prevention cover for preventing the timber from scattering to an outside from an inside of said rotary tub, wherein said scattering prevention cover is inclined downward to a timber charging port of said rotary tub, and transfers the charged timber to said timber charging port.

3. A timber crusher comprising, on a base, a crusher rotating around a substantially horizontal rotation axis for crushing timber into pieces, a rotary tub for guiding the charged timber to said crusher, and a scattering prevention cover for preventing the timber from scattering to an outside from an inside of said rotary tub, wherein a timber charging port is formed at an opening of said rotary tub, said timber charging port being partially defined by an edge portion of said scattering prevention cover which extends from points on a circumference of said rotary tub, and wherein a direction of said edge portion is a direction rotated a predetermined angle, in a rotational direction of said rotary tub, from a rotation axis direction of said crusher, in a plan view.

4. The timber crusher in accordance with claim, 3 wherein the predetermined angle is set based on a composite direction of a velocity component in a rotational direction of said crusher and a velocity component in a rotational direction of said rotary tub.

5. A timber crusher comprising, on a base, a crusher rotating around a substantially horizontal rotation axis and crushing timber into pieces, a rotary tub for guiding the charged timber to said crusher, and a scattering prevention cover for preventing the timber from scattering to an outside from an inside of said rotary tub, wherein said scattering prevention cover forms a timber charging port at an opening of said rotary tub and covers at least part of said crusher exposed into said rotary tub, wherein said scattering prevention cover is inclined downward relative to horizontality toward the timber charging port of said rotary tub.

6. A timber crusher comprising, on a base, a crusher for crushing timber into pieces, a rotary tub for guiding the charged timber to said crusher, and a scattering prevention cover for preventing the timber from scattering to an outside from an inside of said rotary tub, further comprising:

bearers attached on said base, for rotatably attaching said scattering prevention cover, wherein said scattering prevention cover is formed to be expandable and contractible by a plurality of rotatable frames at said bearers and a sheet stretched between said plurality of frames, and freely covers an opening of said rotary tub by expanding and contracting said sheet.

7. The timber crusher in accordance with claims 1, 2–6 or 4, wherein the timber crusher is mounted on a mobile vehicle.

* * * * *